United States Patent [19]

Ho

[11] Patent Number: 4,934,527

[45] Date of Patent: Jun. 19, 1990

[54] MULTI-PURPOSE STATIONERY BOX SET

[75] Inventor: Teng L. Ho, Taipei, Taiwan

[73] Assignee: Patent Master International Corp., Taipei, Taiwan

[21] Appl. No.: 323,889

[22] Filed: Mar. 15, 1989

[51] Int. Cl.[5] ..... A45C 11/34; A47F 7/00; A47B 88/00

[52] U.S. Cl. ..... 206/224; 206/214; 211/69.1; 211/69.5; 211/70; 220/334; 312/284; 312/309; D19/77; D19/84

[58] Field of Search ..... 206/214, 215, 216, 223, 206/224, 411; 211/69.1, 69.5–70; 220/334, 335, 337, 339; D19/77–79, 81, 82, 84, 85; 312/284, 309

[56] References Cited

U.S. PATENT DOCUMENTS

| | | | |
|---|---|---|---|
| 21,990 | 11/1892 | Schneider | D19/82 X |
| D. 179,652 | 2/1957 | Olson | D19/84 X |
| D. 214,348 | 6/1969 | Schroeder | D19/77 |
| D. 214,349 | 6/1969 | McFarland | D19/77 X |
| D. 264,224 | 5/1982 | Henkels | D19/77 X |
| 3,652,142 | 3/1972 | Kneutzweiser | 312/284 X |
| 4,406,368 | 9/1983 | Hermes | 206/371 |
| 4,428,480 | 1/1984 | Ackeret | 312/333 X |
| 4,753,346 | 6/1988 | Tsuji | 206/371 |

FOREIGN PATENT DOCUMENTS

| | | | |
|---|---|---|---|
| 234301 | 11/1963 | Austria | 220/337 |
| 29619 | 8/1958 | Finland | 312/319 |

*Primary Examiner*—Bryon P. Gehman

*Attorney, Agent, or Firm*—Morton J. Rosenberg; David I. Klein

[57] ABSTRACT

A multi-purpose stationery box set including a semi-spherical lower casing, an upper cover pivotally coupled to the semi-circular lower casing, an inner holder set disposed in the lower casing, a bottom block having a drawer and being connected to the lower casing at the bottom thereof. The inner holder is integrally formed therein by an injection molding process to provide a variety of spacings having different sizes and shapes for the convenient arrangement of various stationery accessories in an efficient way with minimized space consumption. By means of the professional design of the stationery box, an attractive outer appearance is provided. Thus, in addition to its multi-purpose usage, it is also very practical and can serve as a decorative ornament.

2 Claims, 6 Drawing Sheets

MULTI-PURPOSE STATIONERY BOX SET

BACKGROUND OF THE INVENTION

The present invention is related to a multi-purpose stationery box set and, more particularly to a stationery box set including a lower casing coupled to an upper cover for receiving therein of an inner holder with a bottom block formed at the bottom. The inner holder includes a variety of spacings for arrangement of various different stationery accessories to provide convenient use thereof. The stationery box set is also of a design so as to serve as a decorative ornament.

The number of regular stationery accessories are innumerable. The most common include such items as: stapler, snap blade cutter, pencil, pen, eraser, scissors, glue bottle, adhesive tape, and memos. Still, there is no suitable, compact and practical container for collectively receiving the variety of stationery accessories in an efficient way. It is commonly seen in the office or elsewhere that various stationery accessories are scattered over the desk or disorderly placed in a drawer. People therefore waste a lot of time finding a specific item from the scattered stationery accessories. Therefore, it is very practical to have a compact stationery container set for arrangement of a variety of stationery accessories. The compact stationéry container set may be designed to have an attractive outer appearance so as to serve as a decorative ornament. This idea comes into the scope of the present invention.

SUMMARY OF THE INVENTION

The main object of the present invention is to provide a multi-purpose stationery box set which includes an inner holder integrally formed by means of an injection molding process to provide a variety of spacings arranged in different sizes and shapes for arrangement of a variety of stationery accessories to provide convenient use and to minimize space consumption. The whole assembly of the stationery box set is designed to be very practical and to serve as a decorative ornament.

The other object of the present invention is to provide a multi-purpose stationery box set wherein the lower casing is pivotally coupled to the upper cover and revolvably connected to the bottom block for convenient adjustment of angular position.

The above and other objects, features and advantages of the present invention will become more apparent from the following detailed description when considered in connection with the accompanying drawings wherein:

DETAILED DESCRIPTION OF THE PREFERRED EMBODIMENT

Figure 1:
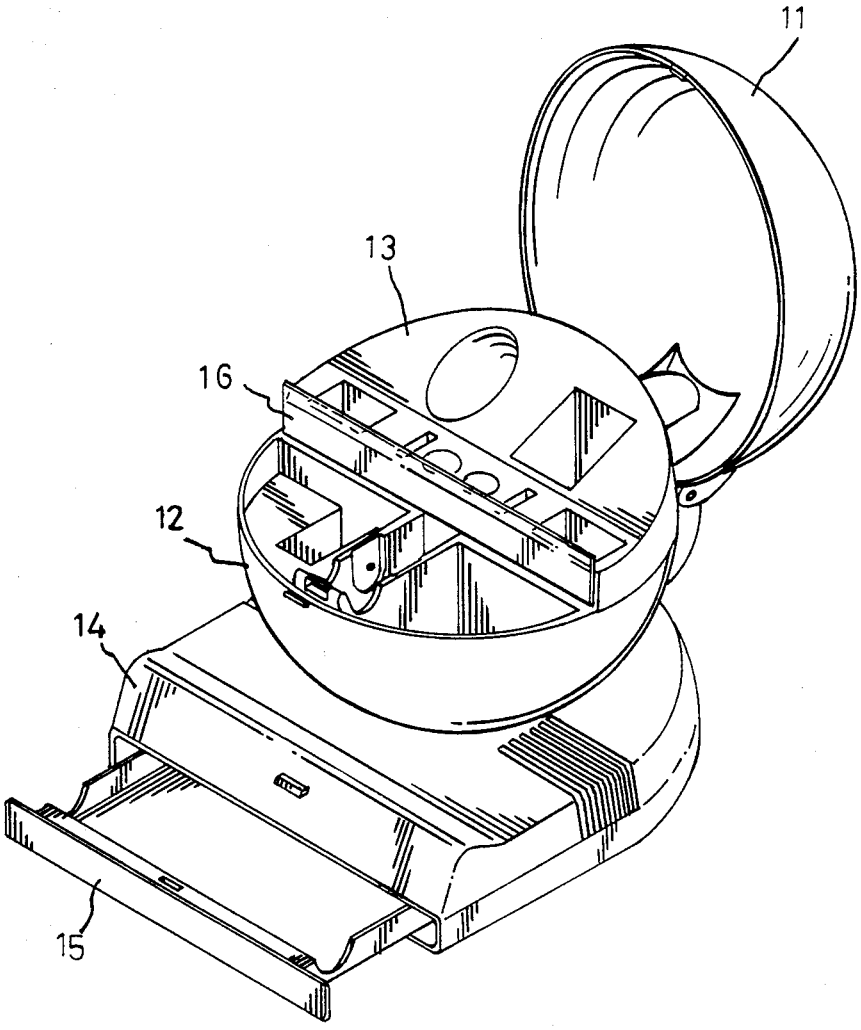
FIG. 1 is a perspective structural view of a multi-purpose stationery box set embodying the present invention.
Figure 2:
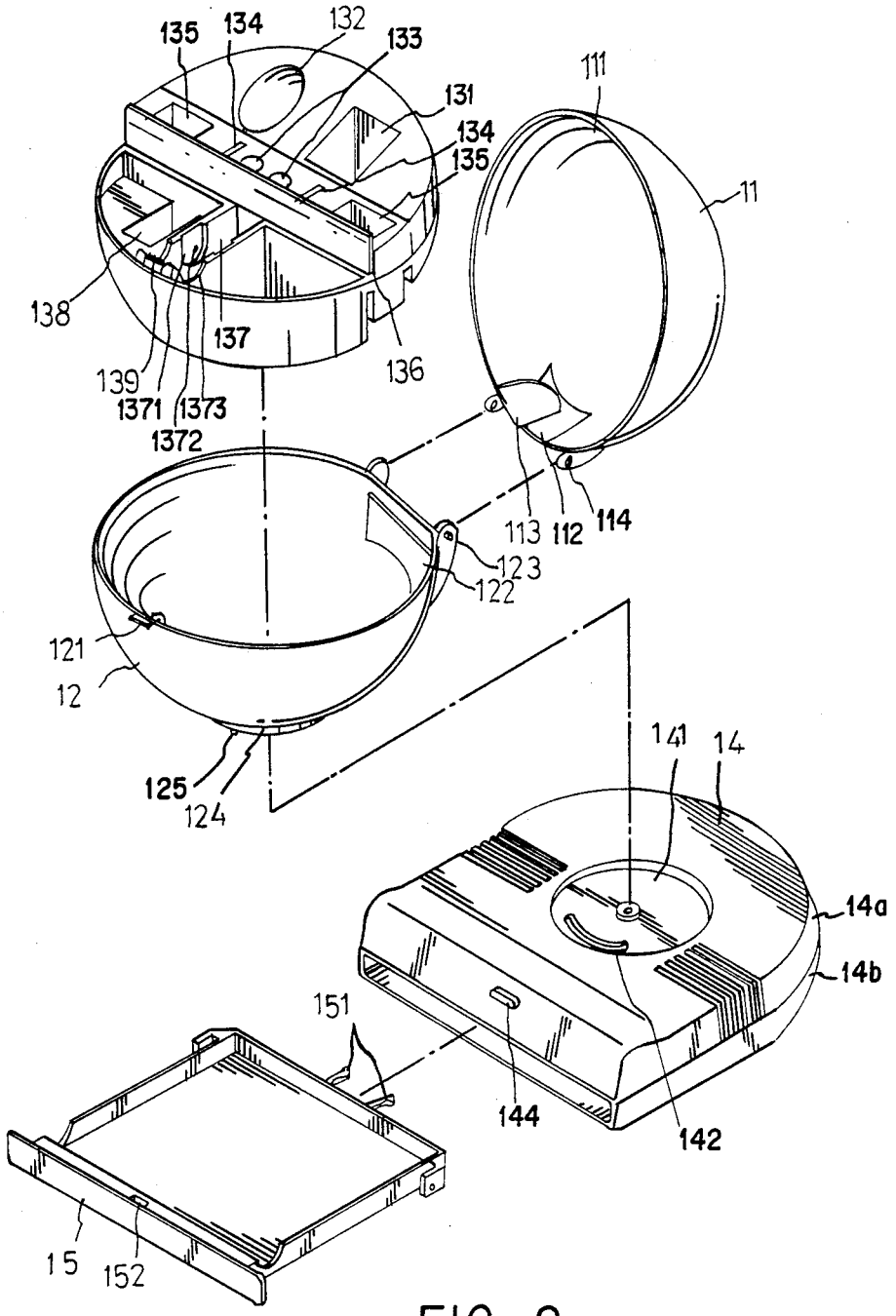
FIG. 2 is a perspective exploded view of the said preferred embodiment of the present invention.

Referring to FIGS. 1 and 2, there is shown a multi-purpose stationery box set according to the present invention. The multi-purpose stationery box includes a semi-spherical upper cover (11), a semi-spherical lower casing (12), an inner holder (13) disposed within the semi-spherical lower casing (12), and a bottom block (14) having a drawer (15).

The inner holder (13) is integrally formed by an injection molding process. The inner holder (13) includes a notch (136) transversely formed at a central portion thereof, for positioning of a division plate (16). Division plate (16) divides the inner space of the inner holder (13) into a first inner portion and a second inner portion. The first inner portion is provided with a rectangular chamber (131) for receiving a stapler therein, a round chamber (132) for receiving a glue bottle therein, two round holes (133) made at the middle for positioning of pens, two elongated slots (134) respectively made on opposing lateral sides of the two round holes (133) for positioning of snap blade cutters, and two rectangular slots (135) respectively made on opposing lateral sides of the two elongated slots (134) for positioning of erasers. The second inner portion is provided with a circular chamber (137) for positioning of adhesive tape, and a slot (138) made on one side of the circular chamber (137) for setting a scissors therein. By means of this structural design, regular stationery accessories may be collectively received in the inner holder (13) to provide convenient storage thereof. Further, a recess (1371) is symmetrically made on opposing bilateral wall surfaces of the circular chamber (137) with a key hole (1372) respectively made on each recess (1371) for the pivotal coupling of a roll of adhesive tape, such that the roll of adhesive tape is allowed to revolve when it is set in the circular chamber (137). As a means of cutting the adhesive tape when it is drawn out for use, a toothed cutting blade (139) is disposed at the front of the circular chamber (137). There is also provided a semi-circular opening (1373) made in the circular chamber (137) at an upper front position thereof for easy access of the user's fingers to dispense the adhesive tape.

Figure 3A:
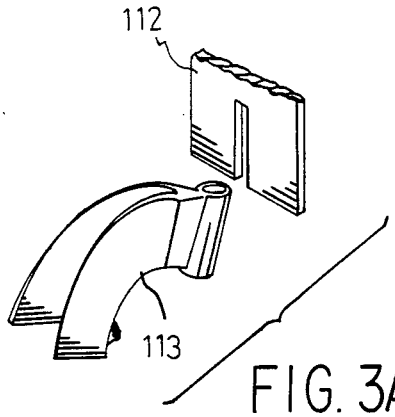
FIG. 3 is a partly structural sectional view of the said preferred embodiment of the present invention.
Figure 3B:
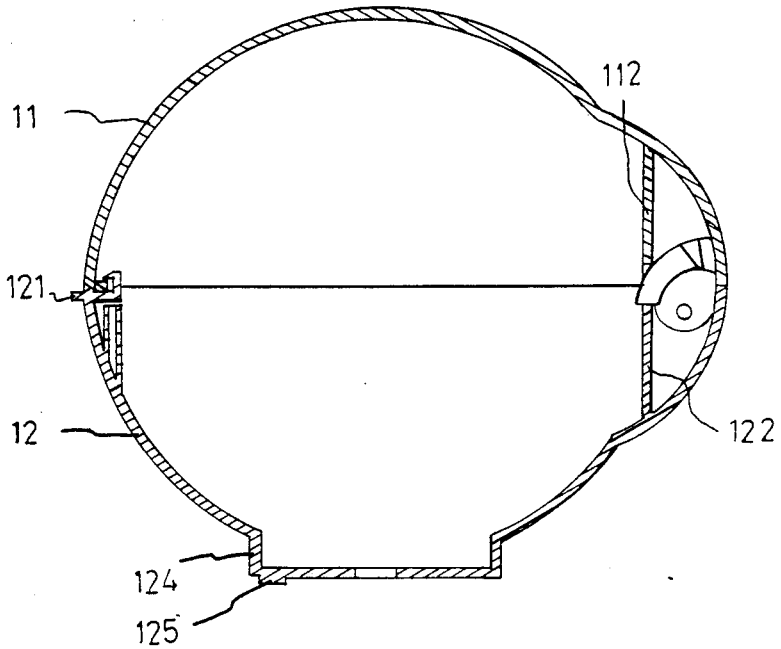

Referring to the structural sectional view of FIG. 3, the upper cover includes a key (111) formed at the front of the upper cover on the inner surface to mate with the key button (121) formed on the lower casing (12) to form a reversably lockable coupling. The upper cover also includes a protruding circular brake holder (112) formed at the back portion thereof. The brake holder (112) has a slotted opening formed therein for positioning of an arch-shaped hinge brake (113).

The hinge brake (113) includes two blades fixedly connected together at one end wherein it is formed into a solid portion, with the opposing ends of two blades having a spring (not shown) disposed therebetween. The solid portion of the two blades of the hinge brake (113) is disposed within the slotted opening of the brake holder (112) to allow the forked two ends stop against a stopper (122) formed at the inner portion of the lower casing (12) at the rear end thereof, to allow the upper cover (11) to be firmly positioned in a lifted position.

In the assembly of the hinge brake (113), the solid portion thereof, wherein the two blades of the hinge brake (113) are joined, is positioned in the groove of the brake holder (112) and the formed blades of the hinge brake (113) are supported by the stopper (122) of the lower casing (12). Then, the two tenons (123), which are formed at the rear end of the lower casing (12), are each respectively inserted into a respective one of the two holes (114), which are formed at the rear end of the upper cover (11). Such provides a pivotal coupling between the lower casing (12) and the upper cover (11), such that the upper cover (11) becomes liftable through the action of the hinge brake.

When the upper cover (11) is pressed down to a closed position, the slotted opening formed in brake holder (112) is concomitantly displaced to further squeeze the hinge brake (113) into a flat configuration, thereby tightening the connection of the hinge brake (113) with the slotted opening of the brake holder (112). Substantially simultaneously, the front key (111) of the upper cover (11) is pressed into a snap fit engagement with the key button (121) of the lower casing (12).

Opening of the upper cover (11) is accomplished by pressing down the key button (121) of the lower casing (12) to allow the key (111) of the upper cover (11) to break away from the restraint of the key button (121). Thus, the brake holder (112) as well as the upper cover (11) are pushed to open by means of the expansion force of the blades of the hinge brake (113) applied to the groove of the brake holder (112). While lifting, the top bumper (115) of the hinge brake (113) serves as a buffer to reduce the lifting speed of the upper cover (11), thereby preventing the stationery box set from falling over, due to a sudden lifting force.

The lower casing (12) which includes a circular bottom seat (124) having a positioning rod (125) coupled thereto at the bottom end of the lower casing (12). The lower casing (12) is positioned at the top of the bottom block (14) with the bottom seat (124) positioned in the top circular recess (141) of the bottom block (14) with the positioning rod (125) being movably positioned in a curved groove (142) formed on the top circular recess (141) of the bottom block (14) for position adjustment.

Figure 4:
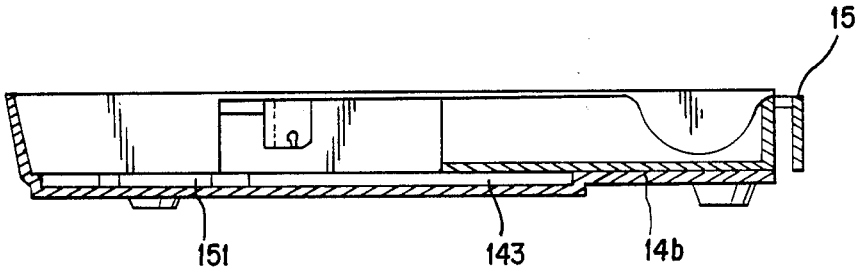
FIG. 4 is a sectional view of the bottom block and the drawer of the said preferred embodiment of the present invention.

According to the present invention, the bottom block (14) includes an upper lid (14*a*) coupled to a base plate (14*b*) by means of screw means to define an inner space therebetween for receiving therein a movable drawer (15). The drawer (15) is preferably designed for receiving memos. Referring to FIG. 4, there is shown base plate (14*b*) which includes therein a reduced concave portion (143) to match with the C-shaped braking means (151) of the drawer (15), such that when the drawer (15) is withdrawn from the bottom block (14), the reduced concave portion (143) and the C-shaped braking means (151) collectively provide a braking action to prevent the drawer from breaking away from the bottom block (14).

When the drawer (15) is closed and entirely set in the bottom block (14), the braking means (151) are stopped against the back side wall of the bottom block (14). The tongue of a key button (144), which is formed at the front top portion of the bottom block (14), is disposed in a slot (152) formed at the front top surface of the drawer (15). This arrangement firmly locks the drawer (15) within the bottom block (14). When it is desired to open the drawer (15), the key button (144) is simply pressed down, letting the slot (152) to be released from the restraint of the tongue of the key button (144). The spring force from the braking means (151) which is pressed against the bottom block (14) will push the drawer (15) to move forward. Through the braking effect of the braking means (151) against the reduced concave portion (143), the forward speed of the drawer is gradually reduced to zero, thereby stopping the displacement of the drawer (15).

Figure 5:
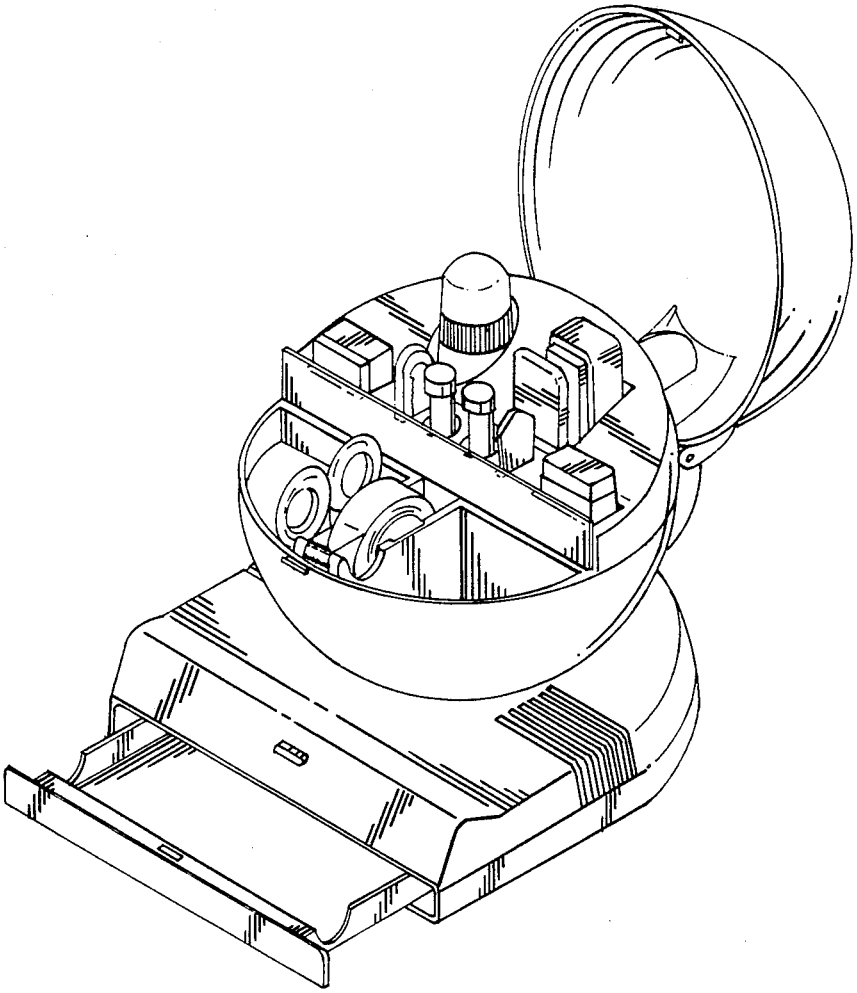
FIG. 5 is a schematic drawing illustrating an opened condition of the said preferred embodiment of the present invention during the application; and, FIG. 6 is a schematic drawing illustrating the outer appearance of the said preferred embodiment of the present invention showing its closed condition.

Referring to FIG. 5, the upper cover (11) is pivoted with respect to the lower casing (12), and the inner holder (13) is disposed in the lower casing (12), wherein the several spacings (131)–(138) are integrally formed in the inner holder (13). The spacings (131–138) are provided for locating of regular stationery accessories including a stapler, a glue bottle, a pen, a snap blade cutter, an eraser, adhesive tape, and a scissors. This arrangement minimizes space consumption and facilitates the arrangement of the stationery accessories.

Figure 6:
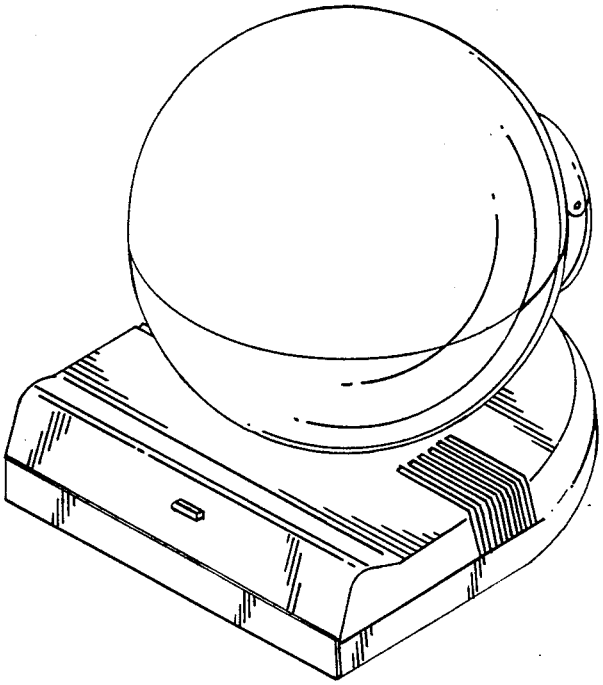

Referring to FIG. 6, the upper cover (11) is closed and in mating relationship with the lower casing (12), and the drawer (15) is locked within the bottom block (14), such that all the stationery accessories arranged thereinside are protected by the upper cover. In addition to its practical application for arrangement of stationery accessories, the attractive design of the outer appearance of the stationery box set also serves as a decorative ornament.

In conclusion, the present invention provides a stationery box set having numerous features each of which tends to make the structure practical for both decoration purposes as well as for convenient arrangement of stationery accessories with space consumption being minimized.

I claim:

1. A multi-purpose stationery box set for holding stationery accessories, comprising:

a substantially semispherical lower casing having front, back and bottom portions, said front portion having a key button formed on an inner surface thereof;

a substantially semispherical upper cover having a front and a back portion being pivotally coupled to said lower casing at said back portion of said lower casing, said upper cover having a key formed on an inner surface of said front portion of said upper cover and positionally located to provide a reversably lockable coupling to said key button, said upper cover includes a protruding circular brake holding member formed in said back portion thereof having a slotted opening;

a hinge brake member having a pair of arch-shaped blades extending from a common first end to a pair of biased apart second ends, said common first end of said pair of blades being received within said slotted opening of said brake holding member whereby said biased apart second ends of said pair of blades are displaced toward each other as said cover is displaced with respect to said lower casing for providing a braking action;

an inner holder disposed within said lower casing having a plurality of integrally formed openings for receipt of said stationery accessories; and, a bottom block defining an inner space wherein a drawer is slidably coupled.

2. A multi purpose stationary box set for holding stationery accessories, comprising:

a substantially semispherical lower casing having front, back and bottom portions, said front portion having a key button formed on an inner surface thereof, said bottom portion of said lower casing having a circular bottom seat formed thereon, said bottom seat having a positioning rod member extending therefrom;

a substantially semispherical upper cover having a front and a back portion being pivotally coupled to said lower casing at said back portion of said lower casing, said upper cover having a key formed on an inner surface of said front portion of said upper cover and positionally located to provide a reversibly lockable coupling to said key button;

an inner holder disposed within said lower casing having a plurality of integrally formed openings for receipt of said stationery accessories; and, a bottom block defining an inner space wherein a drawer is slidably coupled, said bottom block having (1) a circular recess formed in an upper surface thereof for receiving said circular bottom seat therein, and (2) an arcuate groove within said circular recess for receipt of said positioning rod member movably therein, whereby said lower casing is positionally adjustable with respect to said bottom block.

* * * * *